US007967608B2

(12) United States Patent
Chien

(10) Patent No.: US 7,967,608 B2
(45) Date of Patent: Jun. 28, 2011

(54) ELELCTRICAL CONNECTOR WITH MAGNETIC BOARD LOCK

(75) Inventor: Cheng-Ching Chien, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/830,459

(22) Filed: Jul. 6, 2010

(65) Prior Publication Data

US 2011/0003486 A1 Jan. 6, 2011

(30) Foreign Application Priority Data

Jul. 6, 2009 (TW) ..... 98122777

(51) Int. Cl.

| | |
|---|---|
| ***H01R 11/30*** | (2006.01) |
| ***H01R 13/60*** | (2006.01) |
| *H01R 13/62* | (2006.01) |
| *H01R 24/00* | (2006.01) |

(52) U.S. Cl. ..... 439/38; 439/305; 439/326; 439/630

(58) Field of Classification Search ..... 439/38, 439/305, 630, 40, 326
See application file for complete search history.

(56) References Cited

U.S. PATENT DOCUMENTS

| | | | | |
|---|---|---|---|---|
| 7,220,148 | B2 | 5/2007 | Zhao et al. | |
| 2005/0170671 | A1 * | 8/2005 | Niitsu et al. | 439/38 |
| 2010/0291777 | A1 * | 11/2010 | Chien et al. | 439/76.1 |
| 2010/0291785 | A1 * | 11/2010 | Chien et al. | 439/329 |
| 2010/0297858 | A1 * | 11/2010 | Chien | 439/65 |

* cited by examiner

*Primary Examiner* — Hae Moon Hyeon
(74) *Attorney, Agent, or Firm* — Andrew C. Cheng; Wei Te Chung; Ming Chieh Chang

(57) ABSTRACT

An electrical connector includes an insulative housing, a plurality of terminals secured in the housing, a metallic cover pivotally mounted to a rear end of the insulative housing and covering the insulative housing and at least one magnetic board lock secured at one side of the insulative housing and spaced with a distance from the rear end of the insulative housing. The at least one magnetic board lock assist to hold the cover by magnetic attractive force produced between the at least one magnetic board lock and the metallic cover on the insulative housing.

14 Claims, 4 Drawing Sheets

ELELCTRICAL CONNECTOR WITH MAGNETIC BOARD LOCK

BACKGROUND OF THE INVENTION

1. Field of the Invention

The present invention relates to an electrical connector, and more particularly to an electrical connector with a pair of magnetic board locks.

2. Description of the Related Art

U.S. Pat. No. 7,220,148 issued to Shan-Ji Zhao on May 22, 2007 disclosed a conventional electrical connector for electrically connecting a module with a printed circuit board (PCB). The electrical connector includes an insulative base including on its either side an L-shaped rear groove, a recess including a rear ramp, an intermediate protrusion, a tab between the rear ramp and the protrusion, and a front protuberance, and a front stop member; a cover including two side flanges each including a rear pin slidably fitted in and confined by the groove to form a pivot, rear and front gables, and an intermediate tongue; and conductors on a bottom of the base. Sliding the cover forward will interlock the cover and the base by moving either pin to a forward end of the groove with either rear fastening member being urged against the protuberance, either tongue being stopped by the protrusion, and either front fastening member being securely engaged with both the stop member and protuberance after passing the stop member. But the locking engagement of the fastening members and the protrusions would become looser during the long term usage.

In view of the above, a new electrical connector that overcomes the above-mentioned disadvantages is desired.

SUMMARY OF THE INVENTION

Accordingly, an object of the present invention is to provide an electrical connector having an improvement locking arrangement.

To fulfill the above-mentioned object, an electrical connector comprises an insulative housing, a plurality of terminals secured in the housing, a metallic cover pivotally mounted to a rear end of the insulative housing and covering the insulative housing and at least one magnetic board lock secured at one side of the insulative housing and spaced with a distance from the rear end of the insulative housing. The at least one magnetic board lock assist to hold the cover by magnetic attractive force produced between the at least one magnetic board lock and the metallic cover on the insulative housing.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

The present invention will now be described in detail with reference to a preferred embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

Figure 1:
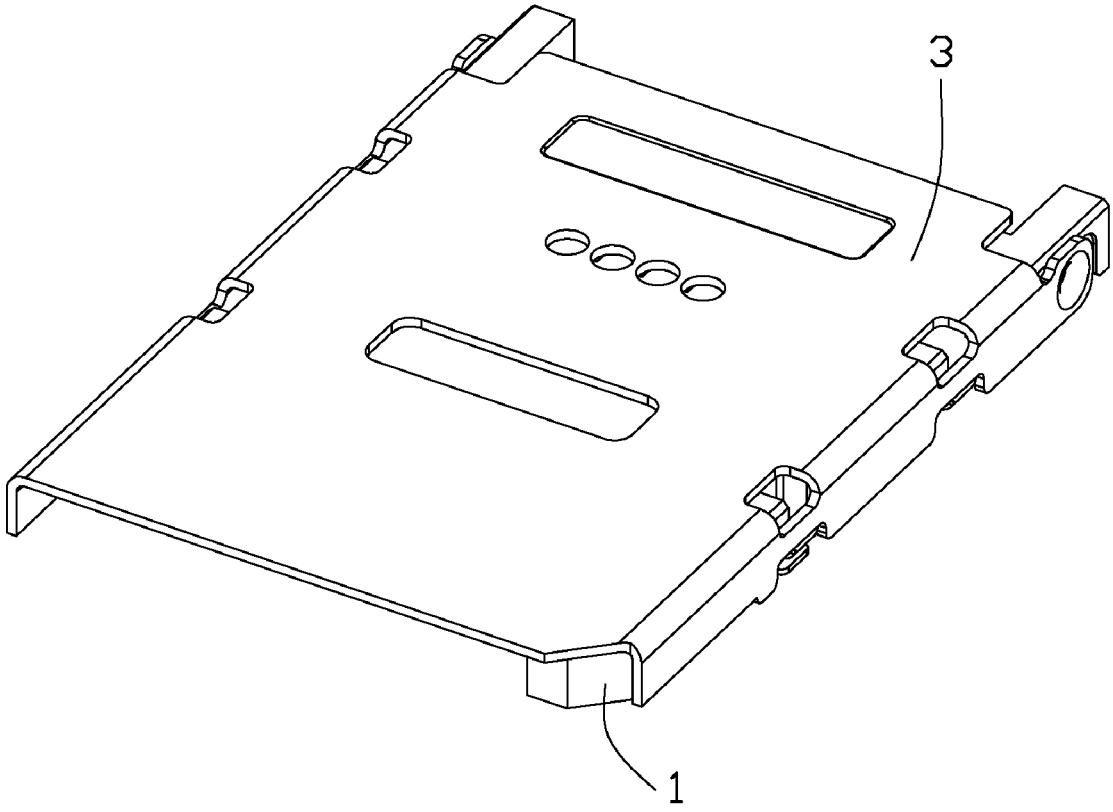
FIG. 1 is a perspective view of an electrical connector in accordance with an embodiment of the present invention.
Figure 2:
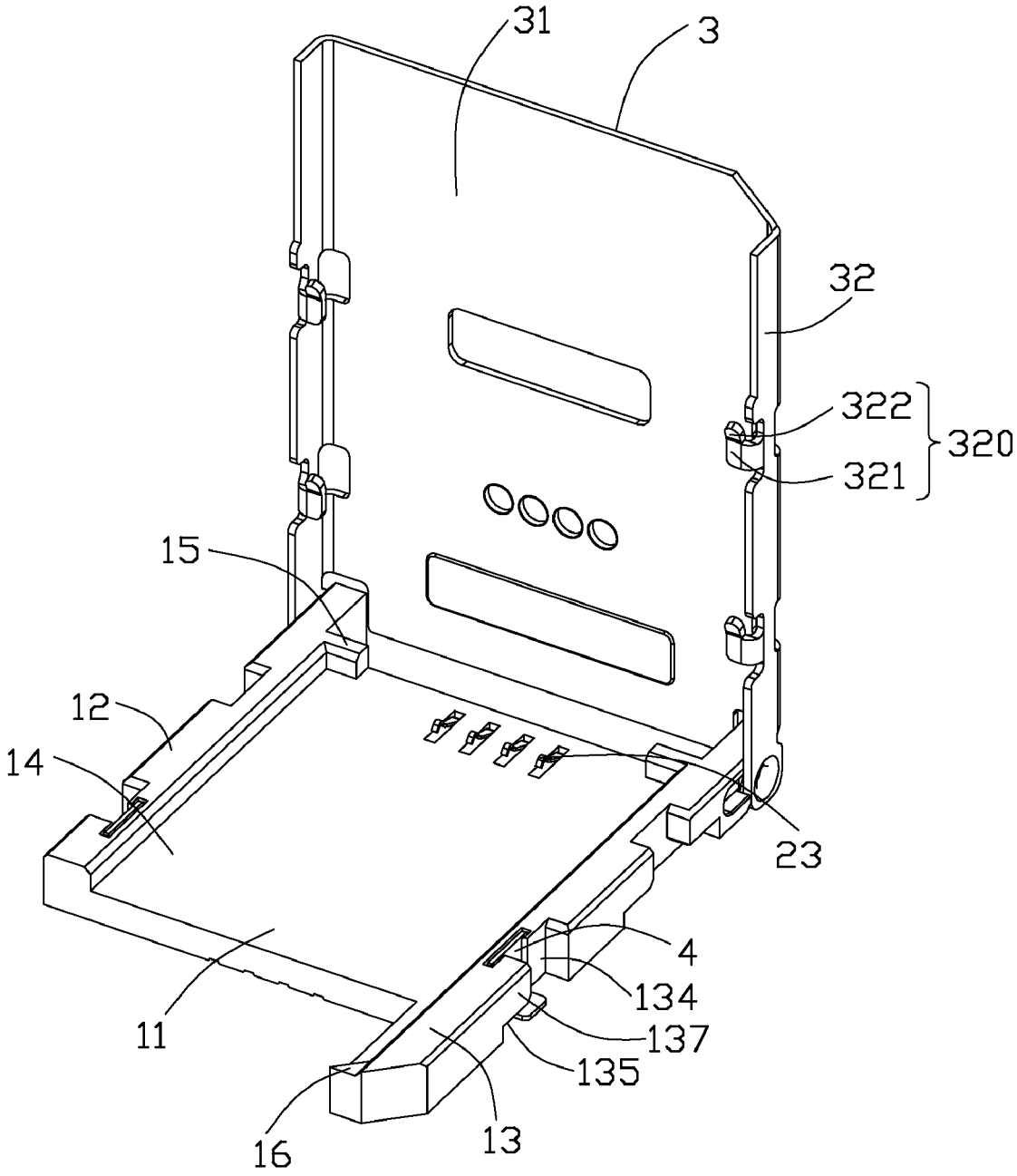
FIG. 2 is a perspective view of the electrical connector, with the cover opened.
Figure 3:
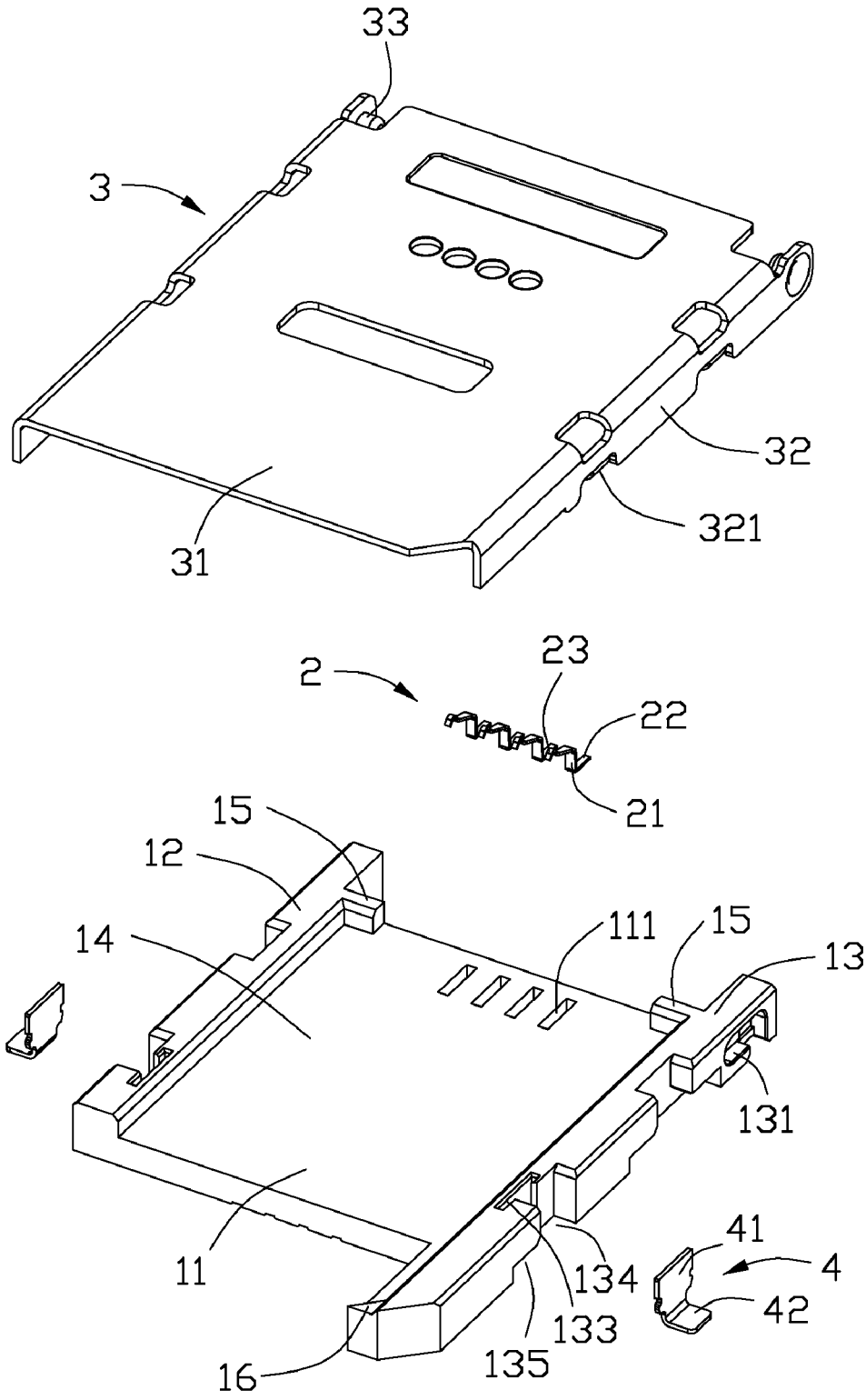
FIG. 3 is an exploded, perspective view of the electrical connector of the FIG. 1.
Figure 4:
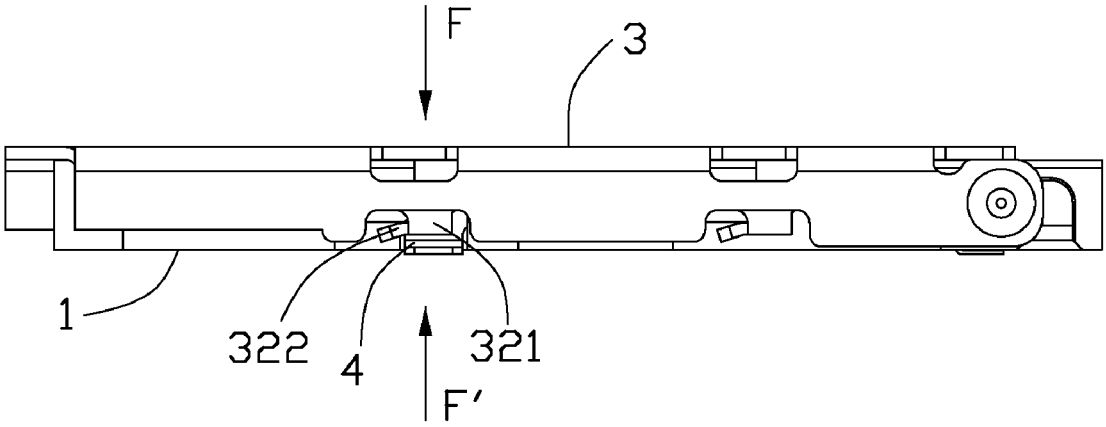
FIG. 4 is an elevational view of the electrical connector of FIG. 1.

Referring to FIGS. 1 to 4, an electrical connector adapted for receiving an optoelectronic module (not shown) comprises an insulative housing 1, a plurality of terminals 2 retained in the insulative housing 1, a metallic cover 3 pivotally mounted to the rear end of the insulative housing 1 and a pair of magnetic board locks 4 secured at two sides of the housing 1. When the metallic cover 3 is located in the opened position as shown in FIG. 2, the optoelectronic module is able to be disposed therein. And when the metallic cover 3 is rotated and positioned into the closed position as shown in FIG. 1, the optoelectronic module is locked within the electrical connector.

The insulative housing 1 defines a base 11 and several peripheral walls upwardly extending from the base 11. The base 11 cooperates with the peripheral walls to commonly define a receiving room 14 to receive the optoelectronic module. The peripheral walls include opposite first side wall 12 and second side wall 13, a front wall 16 connecting with a front end of the side wall 13 and a rear wall 15 opposite to the front wall and connecting with the two ends of the two side walls. The second side wall 13 extends forwardly longer than the opposite side wall 12. Each of the first and second side walls 12, 13 defines an L-shaped groove 131 on a rear corner. Each side wall is further featured with a recess 134 and a locking slot 135 communicated with the recess 134 and a stop portion 137 located above the locking slot 135. The front wall 16 is of a boss shape and adapted to prevent the optoelectronic module from escaping from the insulative housing 1. The base 11 defines a row of passageways 111 near to the rear wall 15 adapted for retaining the terminals 2. Each terminal 2 comprises a retention portion 21 secured in said passageway 111, an engaging portion 23 extending into the receiving room 14 and a soldering portion 22. The rear wall 15 is of two bosses protruding inward to limit the optoelectronic module in the front-to-rear direction together with the front wall 16.

The metallic cover 3 is made of metal sheet and comprises a flat body plate 31 and two flanges 32 extending downwardly from the body plate 31. Each flange 32 includes a shaft 33 on a rear corner and is slidably fitted in the groove 131 to form a pivot. The flange 32 further defines a pair of latches 320 each including an interlock portion 321 corresponding to the stop portion 137 and a guide portion 322 extending forwardly from a front end of the latch portion 320.

The magnetic board locks 4 are attached to the first side wall 12 and the second side wall 13 respectively. Each magnetic board lock 4 includes a soldering section 42 and a retaining section 41 retained in a retaining slot 133 formed on the sidewall so that the magnetic board locks 4 is attached therewith.

When the metallic cover 3 is rotated from the opened position to the closed section, the latch 320 is inserted into the recess 134. Then sliding the cover 3 forwardly will interlock the cover 3 and the housing 1 by moving the shaft 33 forwardly from a bending point of the groove 13 until being stopped by a forward end of the groove 13. Accordingly, the interlock portion 321 is moved to the locking slot 135 under the stop portion 137 to interlock with the stop portion 137. The recesses 134 run through the top face and bottom face of the sidewall 12, 13. The retaining slot 133 is at the inner side of the recess 134 and communicates with the recess 134. In the position, the cover 3 is locked on the insulative housing 1. The latch 320 is located above the soldering section 42 and beside the retaining section 41 of the magnetic board lock 4, which is disposed in the recess 134. In this process, the guide portion 322 is used to guide the interlock portion 321 into the locking slot 135 easily. The magnetic force of attraction F formed between the magnetic board locks 4 and the latches 320 of the metallic cover 3 is configured to make the metallic cover 3 engage with the insulative housing 1 firmly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing;

a plurality of terminals secured in the housing;

a metallic cover pivotally mounted to a rear end of the insulative housing and covering the insulative housing; and at least one magnetic board lock secured at one side of the insulative housing and spaced with a distance from the rear end of the insulative housing;

wherein the at least one magnetic board lock assist to hold the cover by magnetic attractive force produced between the at least one magnetic board lock and the metallic cover on the insulative housing.

2. The electrical connector as claimed in claim 1, wherein the insulative housing defines a base, a first and a second sidewalls perpendicularly extending from the base to commonly define a receiving room, the at least one magnetic board lock are located at the first and second sidewalls respectively.

3. The electrical connector as claimed in claim 2, wherein each magnetic board lock includes a soldering section parallel to a bottom of the insulative housing and a retaining section retained in a retaining slot on the first and second sidewalls of the housing.

4. The electrical connector as claimed in claim 3, wherein each sidewall defines a recess running through the sidewall to receive a latch on the metallic cover and a stop portion to prevent the latch from reversely rotating and hold the metallic cover on the insulative housing.

5. The electrical connector as claimed in claim 4, wherein the retaining slot is located at an inner side of the recess and communicates with the recess so as to expose the at least one board lock to the recess.

6. An electrical connector adapted to receive an optoelectronic module, comprising:

an insulative housing having a receiving room;

a plurality of terminals secured in the insulative housing, each terminal defining an engaging portion exposing to the receiving room;

a metallic cover mounted to the insulative housing and covering the insulative housing; and a pair of magnetic board locks secured at two sides of the insulative housing;

wherein the pair of magnetic board locks assist to hold the cover by magnetic attractive force produced between the pair of magnetic board locks and the metallic cover on the insulative housing.

7. The electrical connector as claimed in claim 6, wherein the insulative housing defines a base, a first and a second sidewalls perpendicularly extending from the base to commonly define the receiving room, the pair magnetic board locks are located at the first and second sidewalls respectively.

8. The electrical connector as claimed in claim 7, wherein each magnetic board lock includes a soldering section parallel to a bottom of the insulative housing and a retaining section retained in a retaining slot on the first and second sidewalls of the housing.

9. The electrical connector as claimed in claim 8, wherein each sidewall defines a recess running through the sidewall to receive a latch on the metallic cover and a stop portion to prevent the latch from reversely rotating and hold the metallic cover on the insulative housing.

10. The electrical connector as claimed in claim 9, wherein the retaining slot is located at an inner side of the recess and communicates with the recess so as to expose the at least one board lock to the recess.

11. An electrical connector comprising:

an insulative housing defining an upward receiving room between opposite front and rear ends and between two opposite side walls;

a plurality of terminals disposed in the housing with contacting sections extending into the receiving room;

a recess defined in one of said side walls;

a locking slot defined in said one of the side walls and communicating with said recess in a front-to-back direction;

a board lock mounted to said one of the side walls with a horizontal pad disposed in the recess and having an upward face thereof;

a cover essentially pivotally mounted to the rear end and equipped with a latch at a position to be located in the recess when said cover is moved to a horizontal position from an open position; wherein at least one of said board lock and said latch is magnetic and the other is metallic so as to result in an interaction feeling for a user when the cover is rotationally moved from the open position to the horizontal position.

12. The electrical connector as claimed in claim 11, wherein a portion of said latch is received in the locking slot when the cover is further horizontally moved forwardly from the horizontal position to a locked position.

13. The electrical connector as claimed in claim 11, wherein the cover is metallic and the board lock is magnetic.

14. The electrical connector as claimed in claim 11, wherein said horizontal pad is soldered upon a printed circuit board on which the housing is seated.

* * * * *